US005507409A

United States Patent [19]

Paradine

[11] Patent Number: 5,507,409

[45] Date of Patent: Apr. 16, 1996

[54] CONTAINER FOR SHIPPING LIQUID RESIN OR ADHESIVE

[75] Inventor: John E. Paradine, Hillsdale, Mich.

[73] Assignee: Essex Specialty Products, Inc., Clifton, N.J.

[21] Appl. No.: 333,468

[22] Filed: Nov. 2, 1994

Related U.S. Application Data

[63] Continuation-in-part of Ser. No. 62,088, May 14, 1993, abandoned.

[51] Int. Cl.[6] ..... B65D 90/04

[52] U.S. Cl. ..... 220/461; 220/403; 220/612; 220/626

[58] Field of Search ..... 220/612, 613, 220/461, 626, 403, 404, 405, 450; 206/216, 219, 447

[56] References Cited

U.S. PATENT DOCUMENTS

| | | | |
|---|---|---|---|
| 2,154,349 | 4/1939 | O'Brien . | |
| 3,101,839 | 8/1963 | Holman | 220/460 |
| 3,321,070 | 5/1967 | Childs | 206/216 |
| 3,539,422 | 11/1970 | Daniele . | |
| 3,784,005 | 1/1974 | McVay . | |
| 3,912,154 | 10/1975 | Godar . | |
| 3,940,052 | 2/1976 | McHugh . | |
| 4,117,971 | 10/1978 | Itoh . | |
| 4,131,226 | 12/1978 | Breiter et al. . | |
| 4,318,475 | 3/1982 | Robinson | 206/447 |
| 4,347,948 | 9/1982 | Hamada et al. . | |
| 4,478,351 | 10/1984 | Homma . | |
| 4,521,116 | 6/1985 | Adsit . | |
| 4,692,132 | 9/1987 | Ikushima et al. . | |
| 4,712,711 | 12/1987 | Geering et al. . | |
| 4,741,934 | 5/1988 | Terayama et al. . | |
| 4,758,648 | 7/1988 | Rizk et al. . | |
| 4,780,520 | 10/1988 | Rizk et al. . | |
| 4,997,661 | 3/1991 | Kromer et al. . | |
| 5,086,151 | 2/1992 | Ito et al. . | |
| 5,169,019 | 12/1992 | Büdenbender . | |
| 5,213,227 | 5/1993 | Koyama et al. . | |
| 5,219,086 | 6/1993 | Björck . | |

FOREIGN PATENT DOCUMENTS

| | | |
|---|---|---|
| 0220997 | 5/1987 | European Pat. Off. . |
| 0447563 | 9/1991 | European Pat. Off. . |
| 501015A1 | 9/1992 | European Pat. Off. . |
| 0513606 | 11/1992 | European Pat. Off. . |
| 4226644 | 2/1994 | Germany . |

*Primary Examiner*—Stephen J. Castellano

[57] ABSTRACT

A container for transporting and storing a liquid comprising an outer container; an inner liner and a top closure film, both inner liner and top closure being films comprising at least one plastic layer and an impermeable layer, and a sealant disposed above the level of contained liquid and between the juncture of the inner liner and top film. The inner liner and top closure are preferably laminate films having an inner, air impermeable (e.g., metal foil) layer between a first plastic (e.g., polyester) layer and a second plastic (e.g., polyethylene) layer.

20 Claims, 2 Drawing Sheets

CONTAINER FOR SHIPPING LIQUID RESIN OR ADHESIVE

CROSS-REFERENCE TO RELATED APPLICATION

This application is a continuation-in-part application of U.S. patent application Ser. No. 08/062,088 filed May 14, 1995, now abandoned.

BACKGROUND OF THE INVENTION

This invention relates to a container, particularly a container for shipping liquids, and to a method for protecting a liquid from the environment during shipping.

Many liquid resin or adhesive systems such as moisture-curable polyurethane polymers (e.g., sealant primers) or polyurethane prepolymers solidify or cure upon exposure to air or moisture. Therefore, it is desirable to minimize contact between these liquids and the environment prior to their end-use application. While exposure to the environment is more or less of a problem depending on the liquid resin or adhesive system employed, the problems associated with premature contact with the environment are aggravated by long periods between preparation of the liquid resin or adhesive and its actual use. This is a particular problem when the liquid resin or adhesive is shipped over long distances or is maintained in the shipping container for long periods of time prior to use.

In a conventional operation, the liquid resin or adhesive is placed in a metal drum, commonly a 55 gallon or larger drum, often lined with a plastic film adhered to the inner metal layer to prevent corrosion and contamination of both the drum and the liquid. The drum is covered with a metal or plastic-coated metal top having approximately the same size as the drum body which is locked to the drum using a locking collar or bung. The means for securing the metal lid or top to the drum body is not particularly effective in preventing the contact of the environment with the drum contents. As such, portions of the liquid resin or adhesive solidify or cure and, upon removal, the solid or cured material is removed with the liquid; thereby introducing impurities into the finished article. It is also necessary to clean the drum after each use. In addition, disposing the metal drum may result in both economic loss and environmental damage.

A filler of a fusible plastic such as polyethylene is often placed in the drum to contain the liquid resin or adhesive and the fusible plastic is then sealed such as by heating or by merely using a tie (see for example U.S. Pat. No. 3,940,052). This provides a more effective barrier between the environment and the contained liquid but, when stored for long periods of time or shipped over long distances, the barrier is not suitable for many applications. In addition, the loose plastic fillers are not easily handled.

Yet another method for shipping a liquid resin or adhesive involves disposing an inner liner of a plastic material having the general shape of the drum which is commonly a paperboard or fiberboard drum against the walls and top of the drum and gluing or otherwise adhering the plastic to the interior surface of the drum (see, for example European Patent Application No. 0 501 015). Alternatively, U.S. Pat. No. 4,347,948 teaches a container in which a plastic inner liner is employed which extends beyond the top of the drum. A typical inner liner consists of an elastic plastic film, including thermoplastic plastic such as polyethylene, polypropylene, polyester, or nylon, as well as compound films such as the plastic with another material (e.g., paper, cloth or metal foil) laminate having layers of polyethylene, metal foil and polyester with the polyethylene layer being closest to and bonded to the interior surface of the drum. The cover or lid comprises a body, a plastic sheet and a ring packing so as to make it possible to seal the container body to be air-tight. These containers do not eliminate the problems associated with premature curing or solidification.

Alternatively, a drum having a plastic inner liner (e.g., a laminate of plastic and metal foil) extending beyond the top of the drum is filled with the liquid to be stored or shipped. Once filled, a plastic (e.g., polyethylene) film, larger than the opening in the drum, is placed over the top of the liquid and the drum sealed using a metal or paper top or lid placed over the polyethylene film. The excess portions of the top film and inner liner contact each other above the liquid layer to seal the container. The problems associated with premature curing or solidification, while reduced, are not eliminated. Upon shipping or storage, the liquid near the seal can solidify or cure, with cured or solidified lumps or droplets contained in the bulk of the liquid material, In view of the stated deficiencies of the prior art, it remains desirable to provide a container for liquid resins and adhesives which reduces or minimizes contact of the resin or adhesive with the drum and the environment (air and moisture) during shipping or storage. Such a container which facilitates easy reuse of the outer drum without complex cleaning steps is desirable.

SUMMARY OF THE INVENTION

Accordingly, in one aspect, the present invention is a container comprising:

a form providing structure defining an enclosed cavity of predetermined shape and having an opening;

an inner liner of a film comprising at least one plastic layer and an impermeable layer, which inner liner conforms generally to the predetermined shape of the structure;

a top closure film comprising at least one plastic layer and an impermeable layer, the top closure layer having a size such that a plastic layer of the top closure film and a plastic layer of the inner liner can be placed in intimate contact with each other;

a sealant disposed between the juncture of the inner liner and top laminate films and means for introducing a liquid into or removing a liquid from the container.

Accordingly, in another aspect, the present invention is a container filled with liquid comprising:

a form providing structure defining an enclosed cavity of predetermined shape and having an opening;

an inner liner of a film comprising at least one plastic layer and an impermeable layer, which inner liner conforms generally to the predetermined shape of the structure;

liquid filling at least a portion of the lined structure such that a portion of the inner liner extends beyond the liquid contained by the structure above the contained liquid;

a top closure film comprising at least one plastic layer and an impermeable layer; the top closure layer having a size such that a plastic layer of the top closure film and a plastic layer of the inner liner can be placed in intimate contact with each other; and a sealant disposed above the level of contained liquid and between the juncture of the inner liner and top laminate films.

In a preferred embodiment, the present invention is a container filled with liquid comprising:

a form providing structure defining an enclosed cavity of predetermined shape and having a fill opening;

an inner liner of a laminate film comprising an impermeable layer between a layer of polyester, and a layer of polyethylene, which inner liner conforms generally to the shape of the structure and is positioned in the cavity so that the polyethylene layer is closest to the inner surface of the structure;

liquid filling at least a portion of the lined structure such that a portion of the inner liner extends beyond the liquid contained by the structure;

a top laminate closure film comprising an impermeable layer between a layer of polyester and a layer of polyethylene placed on the surface of the liquid with the polyester layer being closest to the liquid and having a size such that at least a portion of the top laminate film overlaps the contained liquid such that the polyester layer of the inner liner and the polyester of the top film are in intimate contact with each other; and a sealant disposed above the level of contained liquid and between the juncture of the inner liner and top laminate films.

In a particularly preferred embodiment, the sealant is a moisture-curable adhesive such as a polyurethane prepolymer of an isocyanate and a material which catalyzes or promotes the reaction between an isocyanate and water. A barrier such as a cured sealant further prevents the exposure of the contained liquid to the environment.

The containers of the present invention effectively reduce the amounts of air or moisture to which the liquid is exposed upon shipping or long storage. As such, the liquid resin or adhesive is less susceptible to solidification or curing; thereby facilitating end-use application of the liquid. The containers are particularly useful in shipping or storing moisture-curable polyurethane compositions.

BRIEF DESCRIPTION OF THE DRAWINGS

Understanding of this invention will be facilitated by reference to the accompanying drawings, in which.

DETAILED DESCRIPTION OF THE INVENTION

Figure 1:
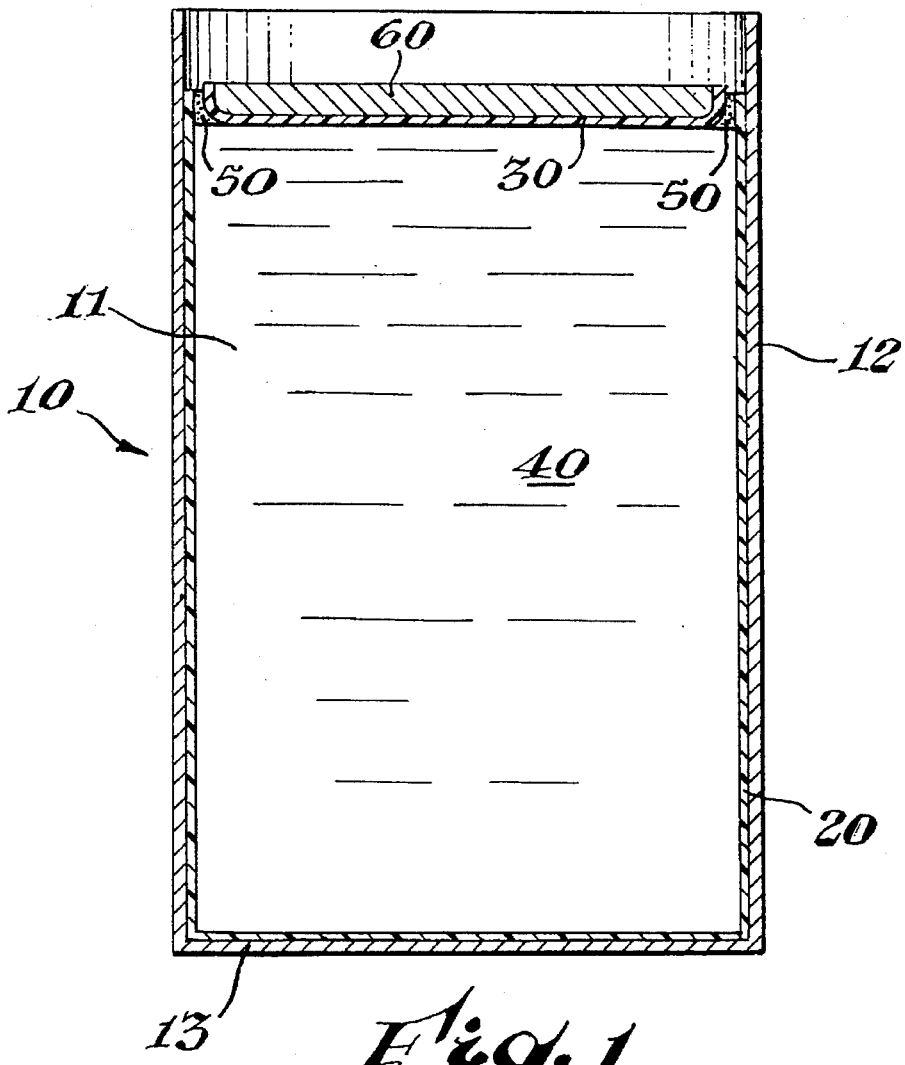
FIG. 1 is a cross-sectional schematic representation of an embodiment of this invention.

Referring now more particularly to the drawings, FIG. 1 which represents an embodiment of this invention 1 depicts a form providing structure 10. The structure is shown in the illustrated embodiment as a container 10 having wall 12 and base 13 but the form providing structure can take essentially any shape. Within the cavity 11 formed by structure 10 and conforming generally to its shape is an inner liner 20. Inner liner 20 can be prepared having a base such as described in U.S. Pat. No. 3,940,052 or having a base portion which is thicker than its side portions such as described in U.S. Pat. No. 4,347,948 (both of which are incorporated herein by reference). Inner liner 20 extends beyond the liquid level 40 in structure 10 and preferably beyond the walls 12. In the depicted embodiment, inner liner 20 is a laminate comprising at least three layers: a plastic (preferably, polyethylene) layer 21, a layer of a gas impermeable layer such as a metal foil 22, and a second plastic (preferably, polyester) layer 23. In the illustrated embodiment, the polyethylene layer is disposed closest to the inner surface of the structure and is preferably glued or bonded to the interior surface of structure 10. The glue or bonding is preferably sufficient to maintain the inner liner in intimate contact with the container during the filling of the container cavity with liquid and shipping but which allows the inner liner to be removed for discarding after use. Conventional techniques for applying the inner liner to the container are suitably employed.

The liquid 40 fills a portion of cavity 11. In the illustrated embodiment, a top closure film 30 covers the liquid 40 in cavity 11 and extends beyond the opening in structure 10. In the illustrated embodiment, film 30 is a laminate comprising a layer of plastic (preferably polyester) 33, a layer of a gas impermeable layer such as a metal foil 32, and a second layer of plastic (preferably, polyethylene) 31 placed on the surface of the liquid with the polyester layer 33 being adjacent to the liquid. In the embodiment depicted in FIG. 1, the portion of top closure film 30 which extends beyond the diameter of structure 10 is disposed adjacent to the portion of the inner liner 20 which extends above the level of liquid contained by container 10. In such a manner, the polyester layer 23 of inner liner 20 and polyester layer 33 of the top film 30 lie adjacent each other.

Figure 2:
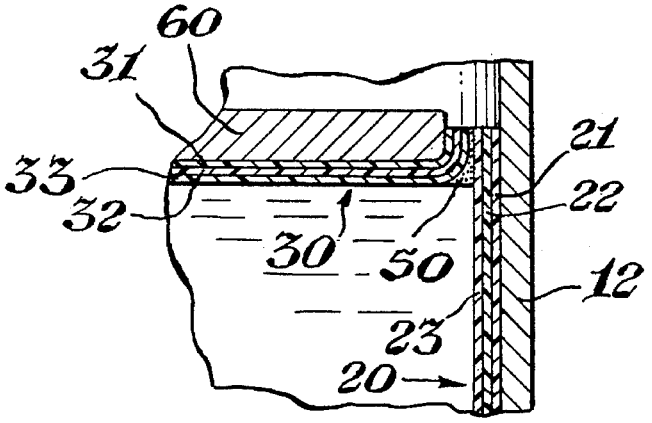
FIG. 2 is a cross-sectional schematic of the juncture between the inner liner and the film lid illustrating a preferred embodiment using an impermeable sealant.

As shown more clearly in FIG. 2, between the polyester layer 23 of inner liner 20 and polyester layer 33 of the top laminate film 30 is disposed a sealant 50. While the adjacent polyester layers in the inner liner 20 and top laminate film 40 reduce the contact of the contained liquid with the environment, the sealant 50 further reduces contact between the environment and liquid and is selected accordingly. In general, sealant 50 is a liquid material which, when exposed to air, moisture, or slightly elevated temperatures will cure or solidify and bond the inner and top laminate films to one another while providing increased protection to the liquid in the container as opposed to if no sealant is employed. Alternatively, the sealant is less preferably a pliable or malleable solid material having suitable impermeability properties.

In constructing the container, after the liquid is placed in the container cavity and the top laminate film placed on the surface of the liquid, the sealant, in liquid form, is placed on the polyester layer 23 of inner film 20 and/or the polyester layer 33 of top film 30, preferably both, and the two films pressed together until the sealant is secured into place such as by curing. In general, it is preferred if the sealant will cure within a few seconds to sufficiently bond the inner and top laminate layers such that further pressure is no longer required to maintain the two layers in position.

In a preferred embodiment, referring to FIG. 1, the structure 10 has an inner liner 20 which contains a moisture-curable sealant composition 40. The top of the inner liner 20 extends above the sealant 40 level. The top closure film 30 is disposed directly on and in contact with the sealant 40. It is preferred to apply a slight amount of pressure to the top closure film 30 to eliminate any air pockets between the sealant 40 and the top closure film 30. Thereafter, a small amount of sealant 40 is pushed or forced into the juncture between the inner liner 20 and the top closure film 30 to form a layer of sealant which is allowed to moisture cure. This is illustrated by FIG. 2 which shows the sealant layer 50.

Preferably, the layer of sealant is about 1 to 2 mils thick and is evenly distributed in the juncture between the inner liner 20 and top closure film 30 so as to form an air-tight seal. Any means of pushing or forcing a portion of the sealant 40 into the juncture to form an even, thin film of sealant 40 may be used. Such means include manipulating the sealant by hand, use of a trowel or use of an automated, appropriately shaped structure wherein air or hydraulic pressure is used to apply the pressure to form a seal of desired thickness.

An additional cover or lid 60 such as a metal or paperboard lid can be and is preferably placed over top film 30 for structural purposes and to prevent damage during shipping and storage.

Figure 3:
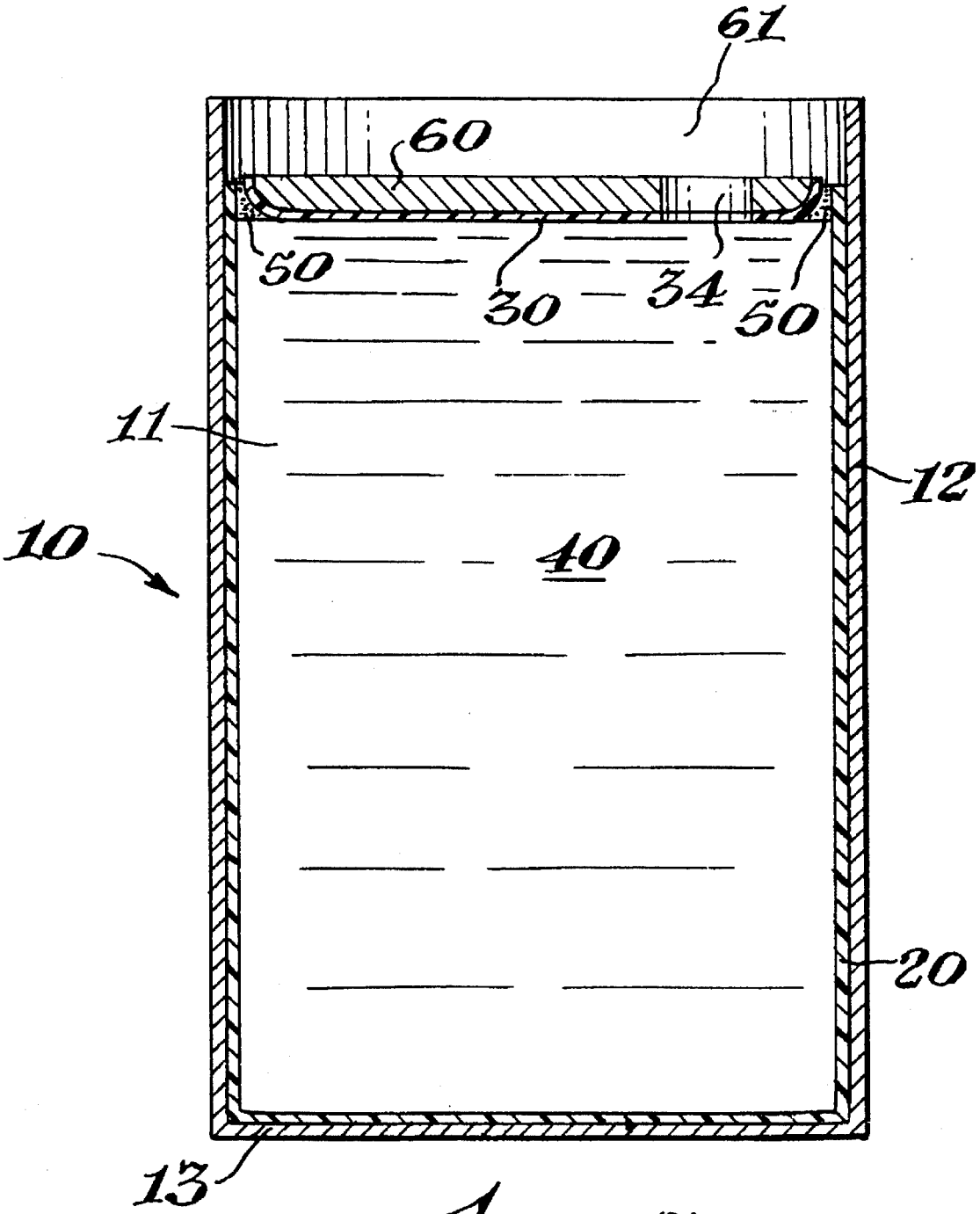
FIG. 3 is identical to FIG. 1, except it further illustrates the dispensing port 34 in the top closure film 30 and a dispensing port 61 in the additional cover 60.

For ease in dispensing the liquid when desired, it is also often advantageous to put a smaller dispensing port, such as described in European Patent Application No. 0 501 015 (which is incorporated by reference herein), in the top laminate film 30 and, if employed, the additional cover, so that the contained liquid can be dispensed through the smaller port without removal of the larger cover or top laminate film such as by means of a dip leg. Preferably, the smaller port is easily removed when it is desirable to dispense the liquid from the container. FIG. 3 is identical to FIG. 1, except it further illustrates the dispensing port 34 in the top closure film 30 and a dispensing port 61 in the additional cover 60.

In the embodiment where the sealant at the juncture of the inner liner and the top closure film is cured prior to filling, some means of introducing a liquid into the container is required. This can be a port which can later be used to remove the liquid. Alternatively, it can be an opening in the top closure film which is sealed after filling. Filling can be performed using means well known in the art. Preferably, the container with the inner liner film in place is filled prior to putting the top closure film and sealant in place.

In another embodiment, the container can be assembled, the sealant for the inner and top laminate film can be contacted and the sealant cured prior to filling of the drum. In such embodiment, the liquid contents can be added to the container through a filling port in the top laminate film or the container can be filled from the bottom by inserting an appropriate filling apparatus through a port in the top of the laminate film.

With regards to the various components employed in the present invention, the form providing structure can take almost any form and size and be made from essentially any material, provided the structure provides a cavity to contain the liquid and the material provides sufficient structural integrity during shipping and storage to prevent damage and loss of the contained liquid. In general, the form providing structure is advantageously a conventional container for shipping liquids such as a metal, fiber, paperboard, plastic container, e.g., a 40- to 60-gallon drum or smaller pail such as a 5-gallon metal pail or bucket, or a cartridge such as a caulking gun cartridge, although larger as well as smaller capacity containers can be employed depending on the amount of liquid to be shipped and/or stored.

Both the inner liner and top laminate films are preferably laminated films comprising a polyethylene layer, a gas impermeable layer, and a polyester layer. If the impermeable layer is a metal foil or the like, an adhesive is generally used to assist in bonding the gas impermeable layer to the polyethylene layer and an adhesive or polymeric film (e.g., linear low density polyethylene) is employed to bond the metal foil to the polyester layer. Yet additional film or adhesive layers are not proscribed.

By the term "polyethylene film layer" is meant a film made from a polymer or copolymer of ethylene, i.e., a polymer derived solely from ethylene or ethylene and one or more monomers copolymerizable therewith. Such polymers (including raw materials, their proportions, polymerization temperatures, catalysts and other conditions) are well-known in the art and reference is made thereto for the purpose of this invention. Additional comonomers which can be polymerized with ethylene include α-olefin monomers having from 3 to 12 carbon atoms, α,β-ethylenically unsaturated carboxylic acids (both mono- and difunctional) and derivatives of such acids such as esters (e.g., alkyl acrylates) and anhydrides; monovinylidene aromatics and monovinylidene aromatics substituted with a moiety other than halogen such as styrene and methylstyrene; and carbon monoxide. Exemplary monomers which can be polymerized with ethylene include 1-octene, acrylic acid, methacrylic acid, vinyl acetate and maleic anhydride.

The ethylene polymers advantageously comprise at least about 50 weight percent ethylene, with the preferred ethylene polymers comprising at least about 75 weight percent ethylene and the more preferred ethylene polymers comprising at least about 90 weight percent ethylene. The preferred ethylene polymers include low density polyethylene, high density polyethylene, linear low density polyethylene (a copolymer of ethylene and up to about 20 weight percent of one or more additional α-olefins having from 3 to 12 carbon atoms, preferably from 4 to 10 carbon atoms, more preferably from 4 to 8 carbon atoms. In general, high density polyethylene and linear low density polyethylene are particularly useful in the practice of the present invention, and, to a lesser extent, due to its higher branching, low density polyethylene. The present invention is also useful for blends of two or more ethylene polymers.

Suitable methods for the preparation of high density polyethylene, low density polyethylene, and linear low density polyethylene polymers are well-known in the art and reference is made thereto for the purposes of this invention.

Linear low density polyethylene (LLDPE) is conventionally a copolymer of ethylene and an α-olefin having 4 or more carbon atoms, preferably from 5 to 10 carbon atoms. LLDPE generally comprises a structure which is intermediate between the long linear chains of HDPE and the highly branched chains of LDPE. The density of LLDPE generally varies from about 0.91 to about 0.94 grams per cubic centimeter (ASTM D 792). Illustrative techniques for the preparation of LLDPE are described in U.S. Pat. Nos. 2,825,721; 2,993,876; 3,250,825; and 4,204,050. As described in these references, in general, LLDPE is prepared by polymerizing a mixture of the desired types and amounts of monomers in the presence of a catalytically effective amount (normally from about 0.01 to about 10 weight percent based on the weight of the ethylene being polymerized) of a coordination catalyst such as described in U.K. Patent 1,500,873. In general, the polymerization is conducted at relatively low pressures (e.g., from about 5 to about 40, preferably from about 5 to about 15 atmospheres) and temperatures from about 0° C. to about 300° C., more preferably from about 60° C. to about 160° C.

Preferred linear low density polyethylenes include copolymers of ethylene with looctene, 4-methyl- 1-pentene, 1-hexene, 1-hexene, or 1-butene, preferably 1-octene. Preferably, the LLDPE copolymers are a copolymer comprising, in polymerized form, from about 99.5 to about 65, more preferably from about 99 to 28 weight percent ethylene and from about 0.5 to about 35, more preferably from about 1 to about 20 weight percent of the higher α-olefin. Most preferably, the LLDPE copolymers comprise from about 98 to about 85 weight percent looctene or 4-methyl-1-pentene, most preferably 1-octene, said weight percents being based on the total weight of the ethylene and 1-octene, 1-hexene, 1-butene, or 4-methy-1-pentene in the resulting copolymer.

In general, high density polyethylene (HDPE) has a density of at least about 0.94 grams per cubic centimeter (g/cc) (ASTM Test Method D 1505). HDPE is commonly produced using techniques similar to the preparation of linear low density polyethylene. When HDPE is employed in the practice of the present invention, it preferably has a density from about 0.96 to about 0.99 g/cc and a melt index from about 0.01 to about 35 grams per 10 minutes as determined by ASTM Test Method D 1238.

Low density polyethylene ("LDPE") is generally comprised of highly branched chains with a density of less than about 0.94, generally from about 0.91 to about 0.94 grams per cubic centimeter (g/cc) (ASTM D 792). Illustrative of techniques for preparing LDPE are described in U.S. Pat. Nos. 3,756,996 and 3,628,918. As described therein, LDPE is conventionally prepared in the presence of a catalytic effective amount of a free radical initiator, e.g., a peroxide such di-tert-butylperoxide or tert-butylperacetate in amounts from 0.1 to about 2 weight percent based on the weight of the monomers. In addition, small amounts of oxygen, e.g., from about 1 to about 100 weight parts per one million parts of monomer are generally advantageously employed in the polymerization. Typically, the polymerization is conducted at relatively high pressures (e.g., from about 100 to about 3000 atmospheres) and temperatures (from about 50° to about 350° C.). In general, pressures from 1000 to 2000 atmospheres and temperatures from 100° to about 300° C. are more typically employed.

The polyethylene layer in the closure or top laminate film is preferably heat sealable and is more preferably an essentially pinhole free or pinhole free, low density, heat-sealable polyethylene. The polyethylene in the inner liner is preferably linear low density polyethylene.

The gas impermeable layer is a film layer prepared from a material which is suitably impermeable to air or the environment for the intended purpose. While the permeability properties of such layer may vary depending on the liquid employed and its susceptibility to moisture or the environment as well as the thickness and specific composition of the polyethylene and polyester film layers, in general, the material employed in preparing the impermeable film layer is a material such that the inner liner and top laminate film have a gas transmission of less than about 0.5, preferably less than 0.2, more preferably less than 0.15 cubic centimeters (cc) per 100 square inches (254 square centimeters) in a 24 hour period (ASTM-1434). Most preferably, the gas permeability is less than about 0.1 cc/100in$^2$/24 hours. In addition, the barrier layer is prepared from a material which is compatible or which can be made compatible with the polyethylene and polyester layers, i.e., the gas impermeable barrier layer can be prepared as a laminate with the polyethylene and polyester layers, such as using an adhesive between one or more of the layers (e.g., the aluminum foil and low density polyethylene) or by coextruding a polyethylene layer between the polyester and metal foil layer. While certain polymers such as vinyl chloride polymers can be employed as the barrier layer, in general, a metal foil or metalized polymer film is most advantageously employed as the impermeable layer. A preferred metal for use as the impermeable layer is aluminum, more preferably an essentially pinhole free or pinhole free, dead-soft, aluminum foil.

The polyester layer is a film made from a polyester material. Polyesters and methods for their preparation (including the specific monomers employed in their formation, their proportions, polymerization temperatures, catalysts and other conditions are well known in the art and reference is made thereto for the purposes of this invention. For purposes of illustration and not limitation, reference is particularly made to pages 1–62 of Volume 12 of the Encyclopedia of Polymer Science and Engineering, 1988 revision, John Wiley & Sons.

Typically, polyesters are derived from the reaction of a di- or polycarboxylic acid with a di- or polyhydric alcohol. Suitable di- or polycarboxylic acids include saturated polycarboxylic acids and the esters and anhydrides of such acids, and mixture thereof. Representative saturated carboxylic acids include phthalic, isophthalic, adipic azelaic, terephthalic, oxalic, malonic, succinic, glutaric, sebacic, and the like. Dicarboxylic components are preferred. Terephthalic acid is most commonly employed and preferred in the preparation of polyester films. α,β-unsaturated di- and polycarboxylic acids (including esters or anhydrides of such acids and mixtures thereof) can be used as partial replacement for the saturated carboxylic components. Representative α,β-unsaturated di- and polycarboxylic acids include maleic, fumaric, aconitic, itaconic, mesaconic, citraconic, monochloromaleic and the like.

Typical di- and polyhydric alcohols used to prepare the polyester are those alcohols having at least two hydroxy groups, although minor amounts of alcohol having more or less hydroxy groups may be used. Dihydroxy alcohols are preferred. Dihydroxy alcohols conventionally employed in the preparation of polyesters include diethylene glycol; dipropylene glycol; ethylene glycol; 1,2-propylena glycol; 1,4-butanediol; 1,4-pentanediol; 1,5-hexanediol and the like with 1,2-propylene glycol being preferred. Mixtures of the alcohols can also be employed. The di- or polyhydric alcohol component of the polyester is usually stoichiometric or in slight excess with respect to the acid. The excess of the di- or polyhydric alcohol will seldom exceed about 20 to 25 mole percent and usually is between about 2 and about 10 mole percent.

The polyester is generally prepared by heating a mixture of the di- or polyhydric alcohol and the di- or polycarboxylic component in their proper molar ratios at elevated temperatures, usually between about 100° C. and 250° C. for extended periods of time, generally ranging from 5 to 15 hours. Polymerization inhibitors such as t-butylcatechol may advantageously be used. The polyester film is preferably a biaxially oriented, pinhole free polyester film.

Metalized polymer films comprise a plastic film having a thin metal deposited on a surface. The metal layer is generally deposited on the film surface as a metal vapor layer in a vacuum. A preferred metal is aluminum. Preferred plastic film comprises polyether polycarbonatess nylons and polypropylene. The preferred films comprise polyesters.

The thickness of the top and inner film layers as well as each layer (i.e., the polyethylene layer, the polyester layer and the barrier layer) in the laminate are dependent on a number of factors including the liquid being shipped or stored in the container, the length of shipping and storage prior to use, and the specific composition employed in each layer of the laminate.

In general, the inner liner will have a total thickness of from about 7 to about 2000, preferably from about 25 to about 500 μm; with the thickness of the polyethylene layer being from about 5 to about 750, preferably from about 10 to about 300 μm; the thickness of the polyester layer being from about 1 to about 250, preferably from about 5 to about 100 μm and the thickness of the barrier layer being from about 1 to about 100, preferably from about 5 to about 50, μm when the barrier layer is a metal foil.

In general, the top laminate film will have a total thickness of from about 16 to about 1000, preferably from about 20 to about 250 micron (μm), with the thickness of the polyethylene layer being from about 10 to about 500, preferably from about 25 to about 200 μm; the thickness of the polyester layer being from about 5 to about 200, preferably from about 15 to about 100 μm; and the thickness of the barrier layer being from about 1 to about 100, preferably from about 5 to about 50 μm when the barrier layer is a metal foil.

Both the inner and the top laminate layers can be prepared by techniques well known in the art for the preparation of film laminates and reference is made thereto for the purposes of this invention.

The sealant is employed to decrease the permeability at the juncture between the inner liner and the top laminate film. In general, any material which reduces permeability of the environment and which sufficiently acts to glue the inner and top laminate layers to one another can be employed and selection of the material which is most advantageous will be dependent on a variety of factors including the contained liquid and its susceptibility to moisture and/or air, the specific inner and top laminate layers employed, and the expected duration of shipping and storage. Representative examples of materials which can be employed as the sealant include hot melt adhesive such as hot melt adhesives based on polyester, polyamides or block copolymer rubbers; adhesives which are applied from solution or dispersion such as phenolics and amino resins which can be applied from water solution, or acrylics or polyurethanes which can be applied from organic solutions, or epoxies applied from aqueous dispersion. An adhesive which can be applied dry and then activated such as by exposure to water or an organic solvent can also be employed. In addition, pressure sensitive adhesives can also be employed. Preferred sealants are those materials which have good shelf life in the absence of air or moisture but which cure rapidly upon exposure to moisture or air.

Particularly preferred adhesives are moisture-curable polyurethanes such as described in U.S. Pat. Nos. 4,758,648; 4,780,520; and 5,086,151. These sealants comprise a polyurethane prepolymer (an isocyanate terminated reaction product of an organic polyisocyanate with a polyhydroxy compound, preferably having an isocyanate functionality of between 2.3 and 3.0) and a catalyst useful for promoting the reaction of isocyanate groups with water. Of the described polyurethane prepolymers, the prepolymers prepared by reacting a stoichiometric excess of a diisocyanate such as diphenylmethane-4,4'-diisocyanate with a mixture of a diol such as polyoxypropylene diol and a triol such as polyoxypropylene triol are particularly preferred. A catalyst such as stannous chloride is commonly employed in such reaction. Preferred compositions comprise a polyurethane prepolymer having an isocyanate functionality of between 2.3 and 3.0 and from 0.2 to about 1.75 weight percent of dimorpholinodiethyl ether and a polyurethane prepolymer having from about 0.2 to about 2 weight percent of a di[2-(3,5-dimethylmorpholino)ethyl] ether catalyst. These materials are particularly useful since they bond to the polyester films on both the inner and the top laminate films, thereby effectively sealing the liquid from the environment.

Using these preferred moisture-curable adhesives as the sealant and in other appropriate cases, the sealant can be the same as the liquid being stored or shipped. In such case, prior to filling the container, the top laminate film is put in place and the container filled from the bottom. Upon completion of filling, the impermeable sealant is cured by its exposure to air, thereby gluing the top laminate and inner liner together to produce an air impermeable seal. Alternatively, the sealant composition is applied to either or both the polyester layer of the inner and top laminate films after filling the container, at which time the films are glued together and the sealant, being exposed to moisture, bonds the films. In general, once applied from the moisture-free environment onto the inner and/or top laminate film, the sealant will effectively cure within about 30 seconds to about 300 minutes, advantageously from about 1 to about 30 minutes.

What is claimed is:

1. A container filled with liquid comprising:

a form providing structure defining an enclosed cavity of predetermined shape and having an opening;

an inner liner of a film comprising at least one plastic layer and an impermeable layer which is positioned in the cavity of the structure, which inner liner conforms generally to the predetermined shape of the structure;

liquid filling at least a portion of the lined structure such that a portion of the inner liner extends beyond the liquid contained by the structure;

a top closure film comprising at least one plastic layer and an impermeable layer; the top closure film having a size such that a portion of the plastic layer of the top closure film and a portion of the plastic layer of the inner liner are disposed adjacent to one another so as to form a closed film structure above the contained liquid; and a sealant comprising a curable or cured composition derived from phenolic and amino resins, acrylics, polyurethanes or epoxies disposed above the level of contained liquid and between the juncture of the inner liner and top laminate films, thereby bonding the inner liner to the top closure film and forming a moisture and air impermeable seal at the juncture, wherein the inner liner and top closure film are removable from the form.

2. A container filled with liquid comprising:

a form providing structure defining an enclosed cavity of predetermined shape and having an opening;

an inner liner of a film comprising at least one plastic layer and an impermeable layer which is positioned in the cavity of the structure, which inner liner conforms generally to the predetermined shape of the structure;

liquid filling at least a portion of the lined structure such that a portion of the inner liner extends beyond the liquid contained by the structure;

a top closure film comprising at least one plastic layer and an impermeable layer; the top closure film having a size such that a portion of the plastic layer of the top closure film and a portion of the plastic layer of the inner liner are disposed adjacent to one another so as to form a closed film structure above the contained liquid; and a sealant comprising a moisture-curable polyurethane disposed above the level of contained liquid and between the juncture of the inner liner and top laminate films, thereby bonding the inner liner to the top closure film and forming a moisture and air impermeable seal at the juncture, wherein the inner liner and top closure film are removable from the form.

3. The container of claim 2 wherein the sealant is a polyurethane prepolymer having an isocyanate functionality of between 2.3 and 3.0 and from 0.2 to about 1.75 weight percent of dimorpholinodiethyl ether.

4. A container filled with liquid comprising:

a form providing structure defining an enclosed cavity of predetermined shape and having a fill opening;

an inner liner of a laminate film comprising an impermeable layer between a layer of polyester and a layer of polyethylene which is positioned in the cavity of the structure, which inner liner conforms generally to the shape of the structure and is positioned in the cavity so that the polyethylene layer is closest to the inner surface of the structure;

liquid filling at least a portion of the lined structure such that a portion of the inner liner extends beyond the liquid contained by the structure;

a top laminate closure film comprising an impermeable layer between a layer of polyester and a layer of polyethylene placed on the surface of the liquid with the polyester layer being closest to the liquid and having a size such that at least a portion of the top laminate film overlaps the contained liquid such that a portion of the polyester layer of the inner liner and a portion of the polyester of the top film are disposed adjacent to one another so as to form a closed film structure above the contained liquid; and a sealant comprising a curable or cured composition derived from phenolic and amino resins, acrylics, polyurethanes or epoxies disposed above the level of contained liquid and between the juncture of the inner liner and top laminate films, thereby bonding the inner liner to the top closure film and forming a moisture and air impermeable seal at the juncture, wherein the inner liner and top closure film are removable from the form.

5. A container filled with liquid comprising:

a form providing structure defining an enclosed cavity of predetermined shape and having a fill opening;

an inner liner of a laminate film comprising an impermeable layer between a layer of polyester and a layer of polyethylene which is positioned in the cavity of the structure, which inner liner conforms generally to the shape of the structure and is positioned in the cavity so that the polyethylene layer is closest to the inner surface of the structure;

liquid filling at least a portion of the lined structure such that a portion of the inner liner extends beyond the liquid contained by the structure;

a top laminate closure film comprising an impermeable layer between a layer of polyester and a layer of polyethylene placed on the surface of the liquid with the polyester layer being closest to the liquid and having a size such that at least a portion of the top laminate film overlaps the contained liquid such that a portion of the polyester layer of the inner liner and a portion of the polyester of the top film are disposed adjacent to one another so as to form a closed film structure above the contained liquid; and a sealant comprising a moisture-curable polyurethane disposed above the level of contained liquid and between the juncture of the inner liner and top laminate films, thereby bonding the inner liner to the top closure film and forming a moisture and air impermeable seal at the juncture, wherein the inner liner and top closure film are removable from the form.

6. The container of claim 5 wherein the sealant is a composition of a polyurethane prepolymer having an isocyanate functionality of between 2.3 and 3.0 and having from 0.2 to about 1.75 weight percent of dimorpholinodiethyl ether or a composition of a polyurethane prepolymer having from about 0.2 to about 2 weight percent of a di[2-(3,5-dimethylmorpholino)ethyl] ether catalyst.

7. The container of claim 5 wherein the inner liner has a total thickness of from 7 to about 2000 micron, with the thickness of the polyethylene layer being from about 5 to about 750 micron, the thickness of the polyester layer being from about 1 to about 250 micron, and the thickness of the barrier layer being from about 1 to about 100 micron.

8. The container of claim 5 wherein the top laminate film has a total thickness of from 16 to about 1000 micron, with the thickness of the polyethylene layer being from about 10 to about 500 micron, the thickness of the polyester layer being from about 5 to about 200 micron, and the thickness of the barrier layer being from about 1 to about 100 micron.

9. The container of claim 5 wherein the inner liner has a total thickness of from 25 to about 500 micron, with the thickness of the polyethylene layer being from about 10 to about 300 micron, the thickness of the polyester layer being from about 5 to about 100 micron, and the thickness of the barrier layer being from about 5 to about 50 micron and the top laminate film has a total thickness of from 20 to about 250 micron, with the thickness of the polyethylene layer being from about 15 to about 200 micron, the thickness of the polyester layer being from about 10 to about 100 micron, and the thickness of the barrier layer being from about 5 to about 50 micron.

10. A container according to claim 1 wherein the sealant is a sealant which cures upon exposure to moisture or air.

11. A container according to claim 2 wherein the inner liner is bonded to the interior surface of the form to retain such liner in place during filling.

12. A container according to claim 11 wherein the liquid is a sealant which cures upon exposure to moisture or air.

13. A container according to claim 12 wherein the form is comprised of a metal, fiberboard, paperboard or plastic and is adapted for shipping liquids.

14. A container according to claim 13 wherein the liquid is a moisture-curable polyurethane.

15. A container according to claim 5 wherein the inner liner is bonded to the interior surface of the form to retain such liner in place during filling.

16. A container according to claim 15 wherein the liquid is a sealant which cures upon exposure to moisture or air.

17. A container according to claim 16 wherein the form is comprised of a metal, fiberboard, paperboard or plastic and is adapted for shipping liquids.

18. A container according to claim 17 wherein the liquid is a moisture-curable polyurethane.

19. A container comprising:

a form providing structure defining an enclosed cavity of predetermined shape and having an opening;

an inner liner of a film comprising at least one plastic layer and an impermeable layer, which inner liner conforms generally to the predetermined shape of the structure;

a top closure film comprising at least one plastic layer and an impermeable layer, the top closure layer having a size such that a portion of the plastic layer of the top closure film and a portion of the plastic layer of the inner liner are disposed adjacent to one another so as to form a closed film structure, wherein the inner liner and top closure film are removable from the form; and a sealant comprising a curable or cured composition derived from phenolic and amino resins, acrylics, polyurethanes or epoxies disposed between the juncture of the inner liner and top laminate films and means for introducing a liquid into the container.

20. A container according to claim 19 wherein the sealant is a moisture-curable polyurethane.

* * * * *